US011814986B2

(12) United States Patent
Hirata

(10) Patent No.: US 11,814,986 B2
(45) Date of Patent: Nov. 14, 2023

(54) TURBINE ROTOR BLADE, TURBINE ROTOR BLADE ASSEMBLY, GAS TURBINE, AND REPAIR METHOD FOR GAS TURBINE

(71) Applicant: MITSUBISHI HEAVY INDUSTRIES, LTD., Tokyo (JP)

(72) Inventor: Norifumi Hirata, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 18/118,349

(22) Filed: Mar. 7, 2023

(65) Prior Publication Data

US 2023/0323778 A1 Oct. 12, 2023

(30) Foreign Application Priority Data

Mar. 24, 2022 (JP) ..... 2022-048817

(51) Int. Cl.

| | |
|---|---|
| ***F01D 5/30*** | (2006.01) |
| ***F01D 5/00*** | (2006.01) |
| ***F01D 5/12*** | (2006.01) |

(52) U.S. Cl.

CPC ..... *F01D 5/3007* (2013.01); *F01D 5/005* (2013.01); *F01D 5/12* (2013.01); *F05D 2220/32* (2013.01); *F05D 2230/80* (2013.01)

(58) Field of Classification Search

CPC ..... F01D 5/3007; F01D 5/005; F01D 5/12; F05D 2220/32; F05D 2230/80

See application file for complete search history.

(56) References Cited

U.S. PATENT DOCUMENTS

| | | | | |
|---|---|---|---|---|
| 4,824,328 | A | 4/1989 | Pisz et al. | |
| 5,147,180 | A * | 9/1992 | Johnson | F01D 5/3007 416/223 A |
| 8,038,404 | B2 * | 10/2011 | Mujezinovic | F01D 5/3007 416/248 |

(Continued)

FOREIGN PATENT DOCUMENTS

| | | |
|---|---|---|
| JP | 63-306208 | 12/1988 |
| JP | 2017-72047 | 4/2017 |
| JP | 2021-131061 | 9/2021 |

*Primary Examiner* — Eldon T Brockman

(74) *Attorney, Agent, or Firm* — Wenderoth, Lind & Ponack, L.L.P.

(57) ABSTRACT

One of spacing between the base-side first tooth and the base-side second tooth or spacing between the base-side second tooth and the base-side third tooth is greater than spacing between the tip-side first tooth and the tip-side second tooth. When, in a cross-section perpendicular to an extension direction of a plurality of teeth, a straight line that connects tooth bottom portions formed between each adjacent teeth in the blade height direction is a first line, an intersection between the first line and a second line that includes a linear portion of a tip-side tooth surface of each of the plurality of teeth is a first intersection, and an intersection between the first line and a third line that includes a linear portion of a base-side tooth surface of each of the plurality of teeth is a second intersection, a distance between the first intersection and the second intersection in the base-side first tooth is greater than a distance between the first intersection and the second intersection in each tooth other than the base-side first tooth.

16 Claims, 7 Drawing Sheets

(56) References Cited

U.S. PATENT DOCUMENTS

| | | | | |
|---|---|---|---|---|
| 8,210,822 | B2 * | 7/2012 | DeMania | F01D 5/3007 416/223 R |
| 8,926,285 | B2 * | 1/2015 | Richter | F01D 5/3007 416/219 R |
| 10,287,898 | B2 * | 5/2019 | Bluck | F01D 5/3023 |

* cited by examiner

TURBINE ROTOR BLADE, TURBINE ROTOR BLADE ASSEMBLY, GAS TURBINE, AND REPAIR METHOD FOR GAS TURBINE

TECHNICAL FIELD

The present disclosure relates to a turbine rotor blade, a turbine rotor blade assembly, a gas turbine, and a repair method for a gas turbine.

BACKGROUND

A blade root portion of a turbine rotor blade used in a turbine such as a gas turbine is repeatedly subjected to centrifugal stress due to a centrifugal load transmitted from an airfoil portion or thermal stress due to a temperature difference from a platform, which is a stress concentration portion. For this reason, in order to suppress the reduction in fatigue life of the turbine rotor blade, efforts have been made to reduce the stress in the blade root portion (see Patent Document 1, for example).

CITATION LIST

Patent Literature

Patent Document 1: JP2021-131061A

SUMMARY

In a blade root portion with a plurality of teeth formed at different positions in the blade height direction, the stress may vary with each tooth. For example, the stress on the tooth closest to the base in the blade height direction may be greater than the stress on the other teeth. In this case, if the thickness of the tooth closest to the base increases, the strength of the tooth increases and the stress decreases, but the side effect is that the stress in the portion of the rotor disc that forms the blade groove in contact with the tooth increases. Therefore, when reducing the stress on the tooth by increasing the thickness of the tooth, it is necessary to consider suppression of the stress on this portion.

In view of the above, an object of at least one embodiment of the present disclosure is to reduce the stress on the blade root portion of the turbine rotor blade while suppressing the side effect.

(1) A turbine rotor blade according to at least one embodiment of the present disclosure includes: an airfoil portion; and a blade root portion having a plurality of teeth formed at different positions in a blade height direction. The plurality of teeth includes a base-side first tooth, a base-side second tooth, and a base-side third tooth extending in a direction intersecting the blade height direction and arranged in order from a side closest to a base in the blade height direction, and a tip-side first tooth and a tip-side second tooth extending in the intersecting direction and arranged in order from a side closest to a tip in the blade height direction. One of spacing between the base-side first tooth and the base-side second tooth or spacing between the base-side second tooth and the base-side third tooth is greater than spacing between the tip-side first tooth and the tip-side second tooth. When, in a cross-section perpendicular to an extension direction of the plurality of teeth, a straight line that connects tooth bottom portions formed between each adjacent teeth in the blade height direction is a first line, in the cross-section, an intersection between the first line and a second line that includes a linear portion of a tip-side tooth surface of each of the plurality of teeth is a first intersection, and an intersection between the first line and a third line that includes a linear portion of a base-side tooth surface of each of the plurality of teeth is a second intersection, a distance between the first intersection and the second intersection in the base-side first tooth is greater than a distance between the first intersection and the second intersection in each tooth other than the base-side first tooth.

(2) A turbine rotor blade assembly according to at least one embodiment of the present invention includes: the turbine rotor blade having the above configuration (1); and a rotor disc having a blade groove portion capable of engaging with the blade root portion of the turbine rotor blade. The blade groove portion has a base-side first blade groove capable of engaging with the base-side first tooth, a base-side second blade groove capable of engaging with the base-side second tooth, a base-side third blade groove capable of engaging with the base-side third tooth, a tip-side first blade groove capable of engaging with the tip-side first tooth, and a tip-side second blade groove capable of engaging with the tip-side second tooth. When the tip-side tooth surface of the tip-side first tooth is in close contact with the tip-side first blade groove, at least a first gap is formed between the tip-side tooth surface of the base-side first tooth and the base-side first blade groove.

(3) A gas turbine according to at least one embodiment of the present disclosure includes a plurality of turbine rotor blades each of which has an airfoil portion and a blade root portion; and a rotor disc having a plurality of blade groove portions capable of engaging with the blade root portions. At least one of the plurality of turbine rotor blades is the turbine rotor blade having the above configuration (1).

(4) A repair method for a gas turbine according to at least one embodiment of the present disclosure is a method for repairing a gas turbine including a plurality of turbine rotor blades each of which has an airfoil portion and a blade root portion and a rotor disc having a plurality of blade groove portions capable of engaging with the blade root portions, and includes a step of replacing at least one of the plurality of turbine rotor blades attached to the rotor disc with the turbine rotor blade having the above configuration (1).

According to at least one embodiment of the present disclosure, it is possible to reduce the stress on the blade root portion of the turbine rotor blade while suppressing the side effect.

DETAILED DESCRIPTION

Embodiments of the present disclosure will be described below with reference to the accompanying drawings. It is intended, however, that unless particularly identified, dimensions, materials, shapes, relative positions, and the like of components described in the embodiments shall be interpreted as illustrative only and not intended to limit the scope of the present disclosure.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

(Overall Configuration of Gas Turbine 1)

Figure 1:
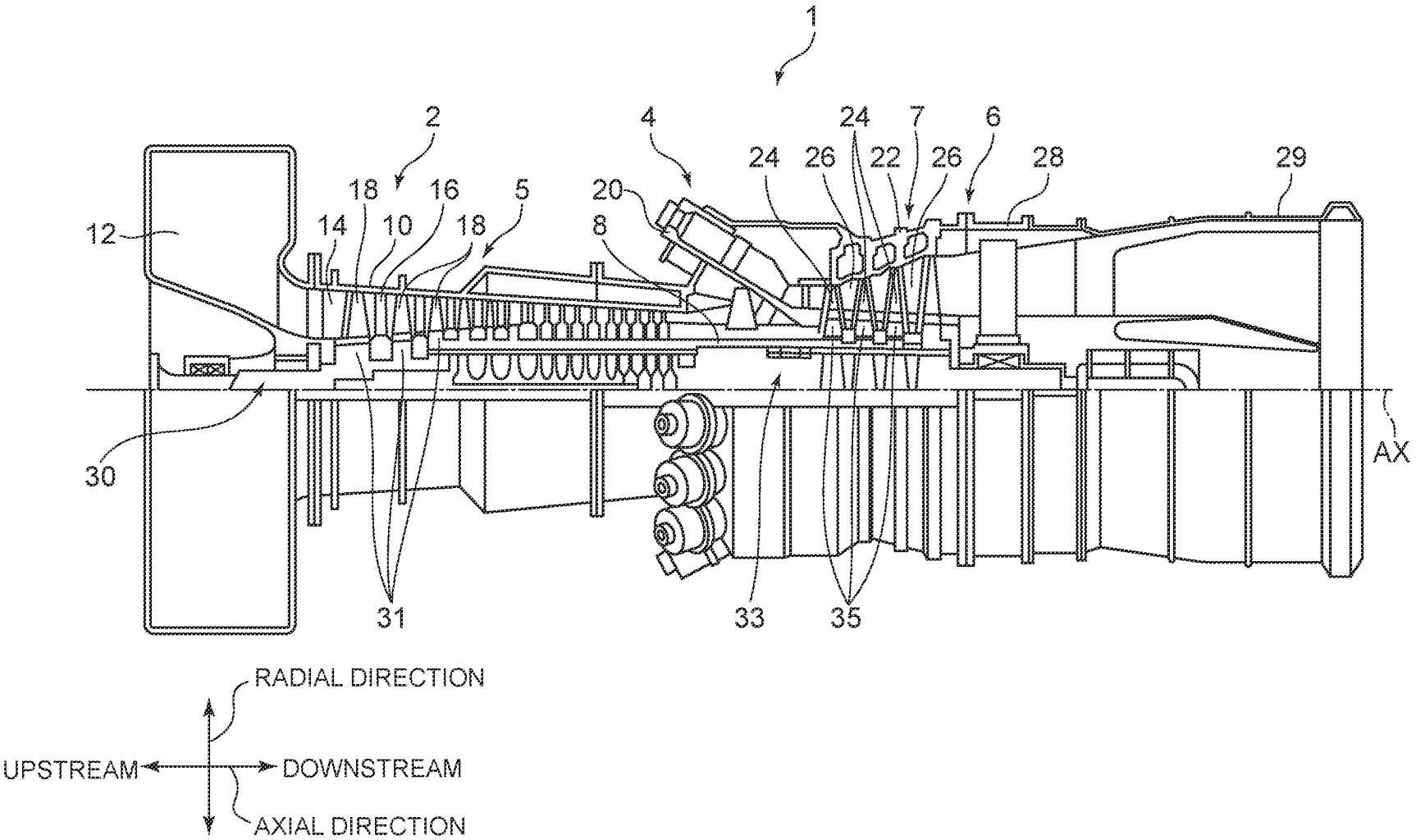
FIG. 1 is a schematic configuration diagram of a gas turbine according to an embodiment.

First, a configuration of a gas turbine to which a turbine rotor blade according to an embodiment is applied will be described with reference to FIG. 1. FIG. 1 is a schematic configuration diagram of a gas turbine 1 according to an embodiment.

As shown in FIG. 1, the gas turbine 1 according to an embodiment includes a compressor 2 for producing compressed air, a combustor 4 for producing combustion gas using the compressed air and fuel, and a turbine 6 configured to be driven by the combustion gas to rotate. In the case of the gas turbine 1 for power generation, a generator (not shown) is connected to the turbine 6, so that rotational energy of the turbine 6 generates electric power.

In the gas turbine 1 shown in FIG. 1, the compressor 2 includes a rotor 30 that is rotatable around the central axis AX and a stator 5 arranged around the rotor 30.

The stator 5 has a compressor casing (casing) 10 and a plurality of compressor stator vanes 16 fixed to the compressor casing 10.

The rotor 30 has a rotor shaft 8 that is rotatable around the central axis AX, a plurality of rotor discs 31 fixed to the rotor shaft 8, and a plurality of compressor rotor blades 18 attached to each of the plurality of rotor discs 31.

The rotor shaft 8 is provided so as to penetrate both the compressor casing 10 and a turbine casing 22 which will be described later.

The compressor rotor blades 18 are arranged in the circumferential direction around the central axis AX on the outer periphery of each of the plurality of rotor discs 31. Further, the rotor discs 31 are arranged in multiple stages at intervals in the direction parallel to the central axis AX. Accordingly, the compressor rotor blades 18 are arranged in multiple stages at intervals in the direction parallel to the central axis AX.

The compressor stator vanes 16 are arranged in the circumferential direction around the central axis AX. Further, the compressor stator vanes 16 are arranged in multiple stages at intervals in the direction parallel to the central axis AX. The compressor stator vanes 16 are arranged in multiple stages alternately with the compressor rotor blades 18 in the direction parallel to the central axis AX.

Further, in the gas turbine 1 shown in FIG. 1, the compressor 2 includes an air inlet 12 disposed on the inlet side of the compressor casing 10 for sucking in air, and an inlet guide vane 14 disposed near the air inlet 12. The compressor 2 may include other components, such as an extraction chamber (not shown). In the compressor 2, the air sucked in from the air inlet 12 flows through the plurality of compressor stator vanes 16 and the plurality of compressor rotor blades 18 to be compressed into compressed air. The compressed air is sent from the compressor 2 to the combustor 4 downstream.

In the gas turbine 1 shown in FIG. 1, the combustor 4 is disposed in a casing (combustor casing) 20. As shown in FIG. 1, a plurality of combustors 4 may be arranged annularly around the rotor shaft 8 within the casing 20. The combustor 4 is supplied with fuel and the compressed air produced by the compressor 2, and combusts the fuel to produce high-temperature and high-pressure combustion gas that serves as a working fluid of the turbine 6. The combustion gas is sent from the combustor 4 to the turbine 6 of a latter stage.

In the gas turbine 1 shown in FIG. 1, the turbine 6 includes a rotor 33 that is rotatable around the central axis AX and a stator 7 arranged around the rotor 33.

The stator 7 has a turbine casing (casing) 22 and a plurality of turbine stator vanes 26 fixed to the turbine casing 22.

The rotor 33 has the above-described rotor shaft 8, a plurality of rotor discs 35 fixed to the rotor shaft 8, and a plurality of turbine rotor blades 24 attached to each of the plurality of rotor discs 35.

The turbine rotor blades 24 are arranged in the circumferential direction around the central axis AX on the outer periphery of each of the plurality of rotor discs 35. Further, the rotor discs 35 are arranged in multiple stages at intervals in the direction parallel to the central axis AX. Accordingly, the turbine rotor blades 24 are arranged in multiple stages at intervals in the direction parallel to the central axis AX.

The turbine stator vanes 26 are arranged in the circumferential direction around the central axis AX. Further, the turbine stator vanes 26 are arranged in multiple stages at intervals in the direction parallel to the central axis AX. The turbine stator vanes 26 are arranged in multiple stages alternately with the turbine rotor blades 24 in the direction parallel to the central axis AX.

In the turbine 6, the rotor shaft 8 extends in the axial direction (right-left direction in FIG. 1), and the combustion gas flows from the combustor 4 to an exhaust casing 28 (from left to right in FIG. 1). Therefore, in FIG. 1, the left side is the axially upstream side, and the right side is the axially downstream side. In the following description, the term "axial direction" indicates the direction parallel to the central axis AX, and the term "radial direction" indicates the radial direction with respect to the central axis AX. In the following description, the term "circumferential direction of the rotor" or simply "circumferential direction" indicates the circumferential direction with respect to the central axis AX.

The turbine rotor blades 24 and the turbine stator vanes 26 are configured to generate rotational driving force from the high-temperature and high-pressure combustion gas flowing inside the turbine casing 22. When the rotational driving force is transmitted to the rotor shaft 8, the generator (not shown) connected to the rotor shaft 8 is driven.

An exhaust chamber 29 is connected to the axially downstream side of the turbine casing 22 via the exhaust casing 28. The combustion gas having driven the turbine 6 passes through the exhaust casing 28 and the exhaust chamber 29 and then is discharged outside.

(Configuration of Turbine Rotor Blade 24)

Next, the turbine rotor blade 24 according to an embodiment will be described. In the following description, the turbine rotor blade 24 of the turbine 6 of the gas turbine 1 will be described as the turbine rotor blade 24 according to an embodiment, but in other embodiments, the turbine rotor blade may be a turbine rotor blade of a steam turbine.

Figure 2:
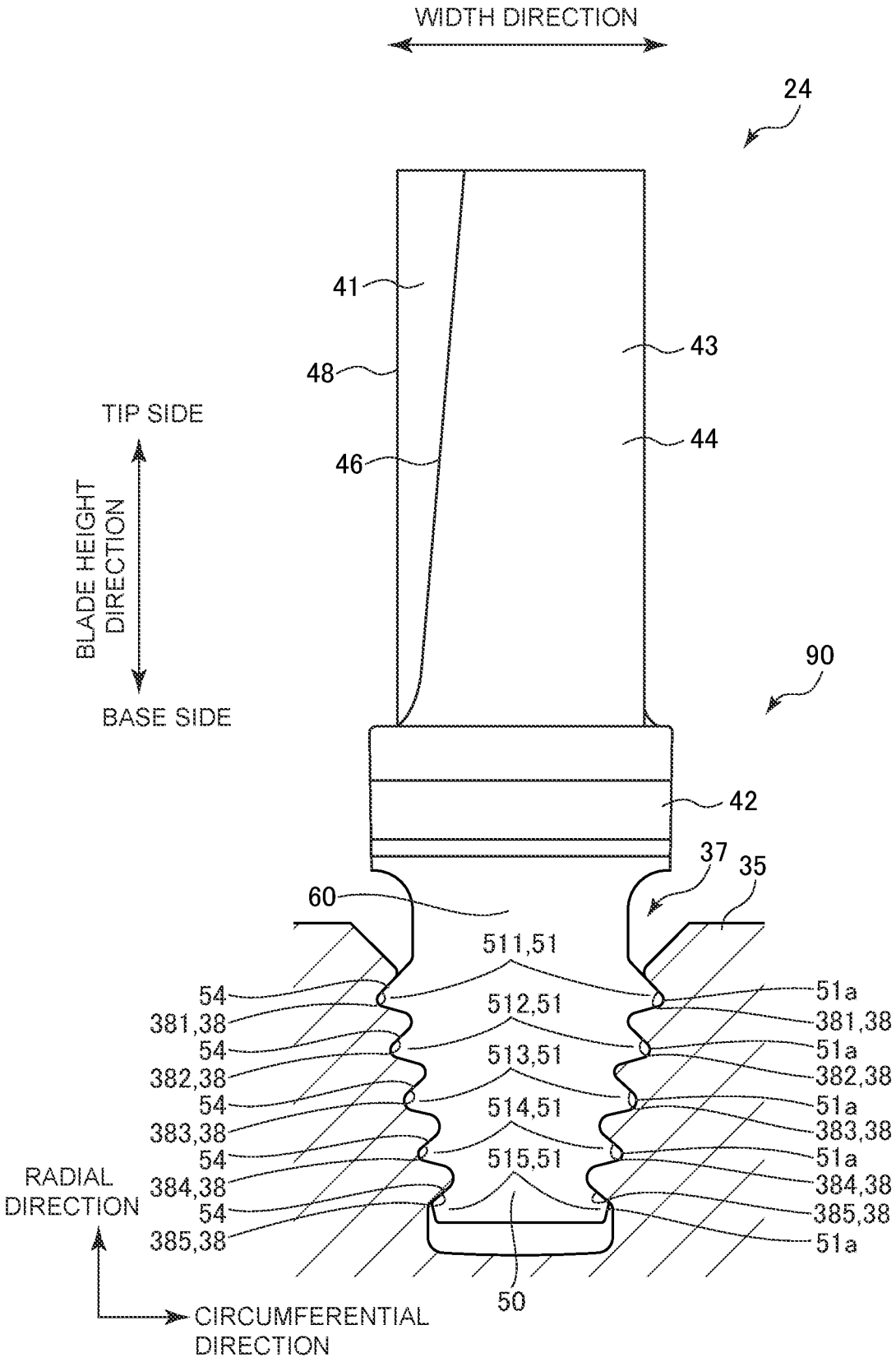
FIG. 2 is a diagram of a turbine rotor blade according to an embodiment, viewed in a direction from the leading edge to the trailing edge (chord direction).
Figure 3:
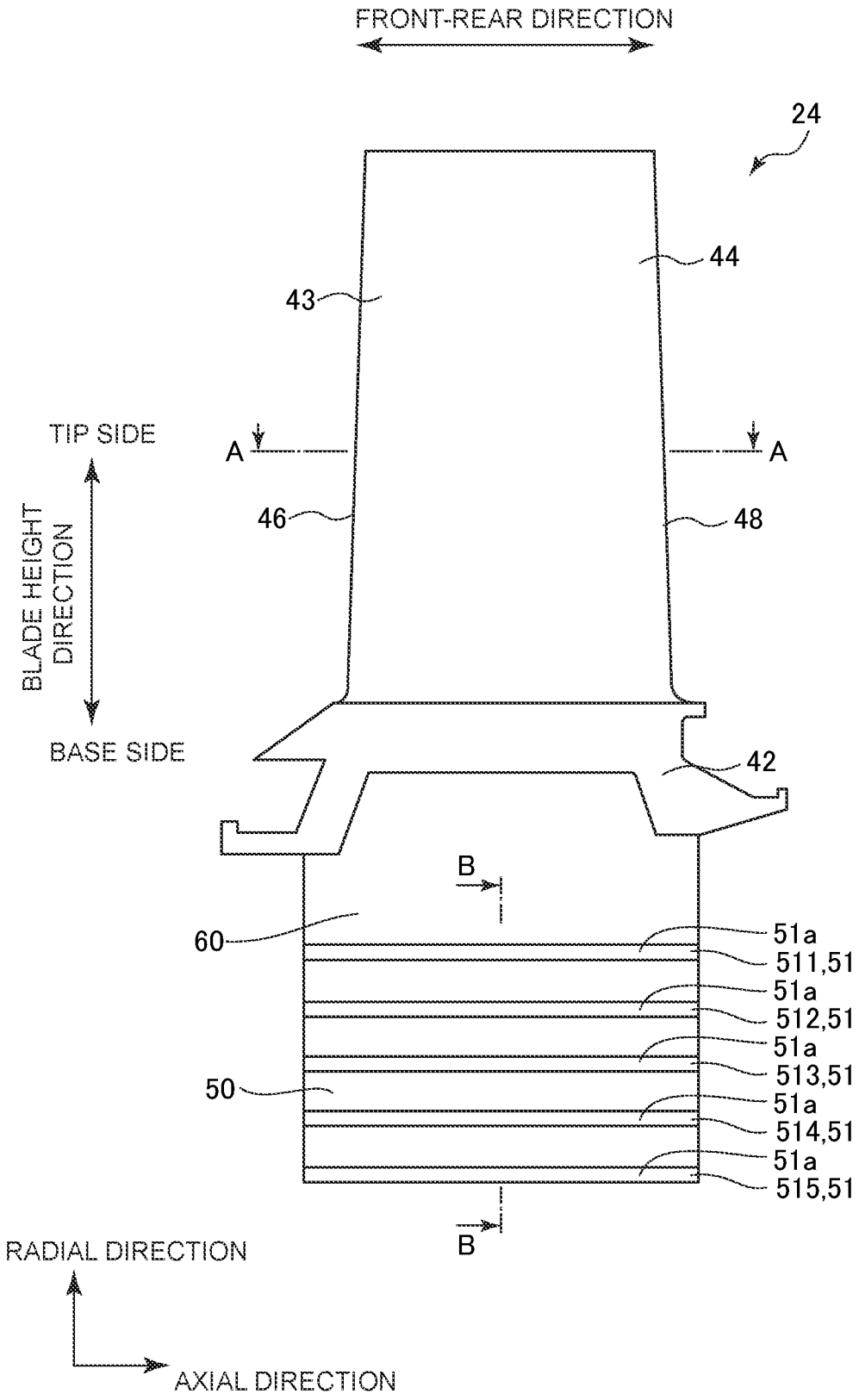
FIG. 3 is a schematic diagram of the turbine rotor blade shown in FIG. 2, viewed in a direction from the suction surface to the pressure surface (rotor circumferential direction).
Figure 4:
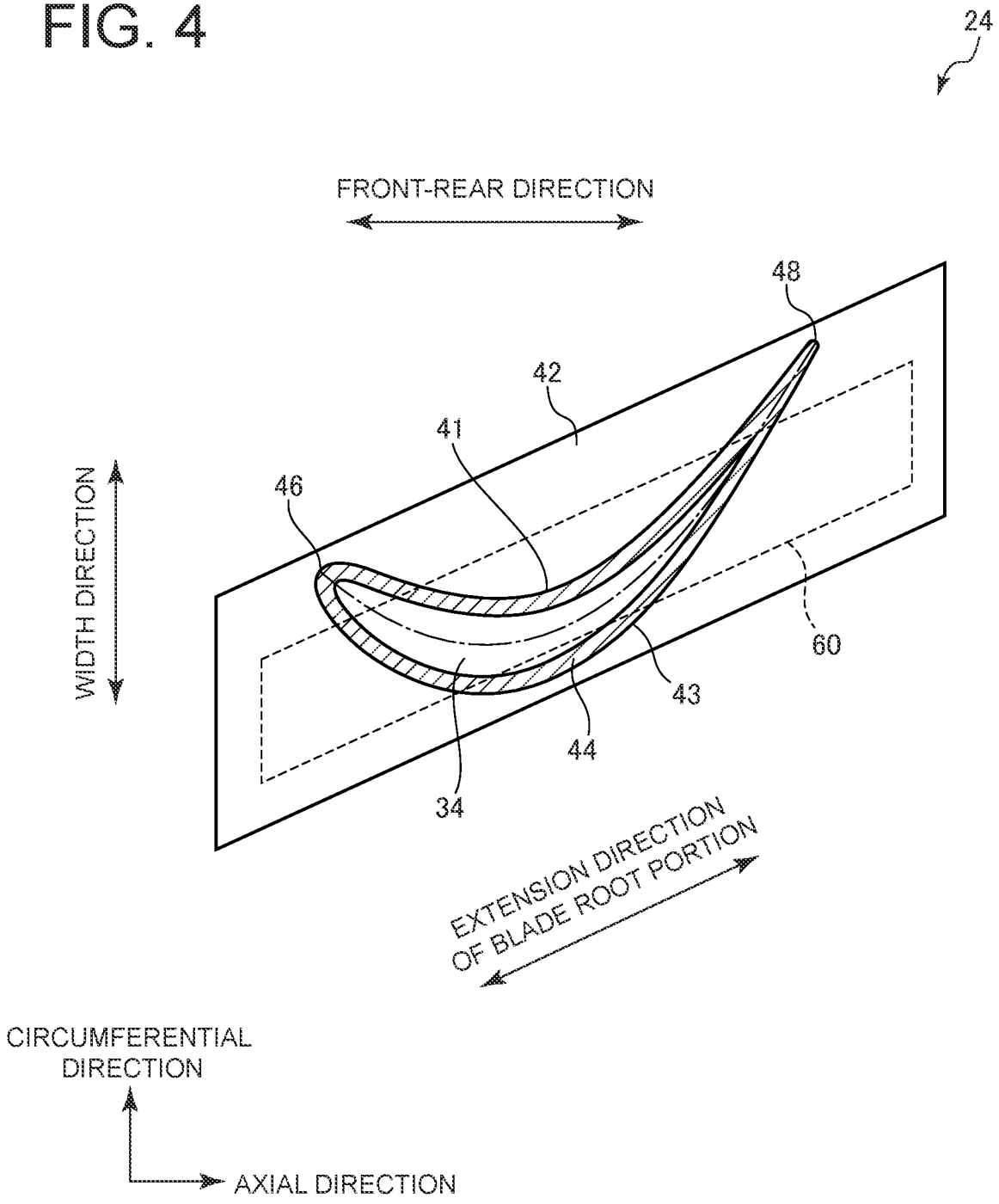
FIG. 4 is a cross-sectional view taken along line A-A in FIG. 3.

FIG. 2 is a diagram of the turbine rotor blade 24 according to an embodiment, viewed in a direction from the leading edge to the trailing edge (chord direction). FIG. 3 is a schematic diagram of the turbine rotor blade 24 shown in FIG. 2, viewed in a direction from the suction surface to the pressure surface (rotor circumferential direction). FIG. 4 is a cross-sectional view taken along line A-A in FIG. 3. In FIG. 2, the turbine rotor blade 24 is depicted together with the rotor disc 35 of the turbine 6.

As shown in FIGS. 2 to 4, the turbine rotor blade 24 according to an embodiment includes a platform 42, an airfoil portion 44 and a blade root portion 50 disposed on opposite sides of the platform 42 in the blade height direction (also referred to as span direction), and a shank 60 disposed between the platform 42 and the blade root portion 50. The airfoil portion 44, the platform 42, the blade root portion 50, and the shank 60 may be formed integrally by casting or the like.

When the turbine rotor blade 24 is attached to the rotor disc 35, the blade height direction of the turbine rotor blade 24 coincides with the radial direction. In the following description, the tip side in the blade height direction is the radially outer side when the turbine rotor blade 24 is attached to the rotor disc 35, and the base side in the blade height direction is the radially inner side when the turbine rotor blade 24 is attached to the rotor disc 35. Further, in the following description, the tip side in the blade height direction is also simply referred to as the tip side, and the base side in the blade height direction is also simply referred to as the base side.

The airfoil portion 44 is disposed so as to extend in the blade height direction with respect to the rotor disc 35. The airfoil portion 44 has a leading edge 46 and a trailing edge 48 extending along the blade height direction, and has a pressure surface 41 and a suction surface 43 extending between the leading edge 46 and the trailing edge 48. As shown in FIG. 4, a hollow portion 34 may be formed inside the airfoil portion 44. The hollow portion 34 may function as a cooling passage through which a cooling fluid for cooling the airfoil portion 44 flows.

As shown in FIG. 2, in the turbine 6, the blade root portion 50 is engaged with a blade groove portion 37 provided in the rotor disc 35. Thus, the turbine rotor blade 24 is implanted on the rotor disc 35 of the turbine 6, and rotates together with the rotor disc 35 around the central axis AX.

(Blade Root Portion 50)

In the turbine rotor blade 24 according to an embodiment, the blade root portion 50 has a plurality of teeth 51 formed at different positions in the blade height direction. Each of the teeth 51 extends in the extension direction of the blade root portion 50, i.e., a direction intersecting the blade height direction, and has a tooth tip portion 51*a* protruding in the width direction of the blade root portion 50.

Herein, the "width direction" of the blade root portion 50 means a direction crossing the turbine rotor blade 24 from the pressure surface 41 to the suction surface 43 (or from the suction surface 43 to the pressure surface 41) of the airfoil portion 44. The width direction of the blade root portion 50 corresponds to the circumferential direction of the rotor 33.

In the turbine rotor blade 24 according to an embodiment, for example, five teeth 51 are formed at different positions in the blade height direction on one side and the other side in the width direction of the blade root portion 50. The five teeth 51 at different positions in the blade height direction are a first tooth 511, a second tooth 512, a third tooth 513, a fourth tooth 514, and a fifth tooth 515 in order from the tip.

The positions of the teeth 51 approach the center of the blade root portion 50 in the width direction from the tip side to the base side in the blade height direction.

The first tooth 511 is also referred to as a tip-side first tooth, and the second tooth 512 as a tip-side second tooth. The fifth tooth 515 is also referred to as a base-side first tooth, the fourth tooth 514 as a base-side second tooth, and the third tooth 513 as a base-side third tooth.

The blade groove portion 37 provided in the rotor disc 35 has five blade grooves 38 on opposite sides of the blade root portion 50 in the width direction of the blade root portion 50, which engage with the five teeth 51 at different positions in the blade height direction. Of the five blade grooves 38, the blade groove 38 engaging with the first tooth 511 is a first blade groove 381, the blade groove 38 engaging with the second tooth 512 is a second blade groove 382, and the blade groove 38 engaging with the third tooth 513 is a third blade groove 383. The blade groove 38 engaging with the fourth tooth 514 is a fourth blade groove 384, and the blade groove 38 engaging with the fifth tooth 515 is a fifth blade groove 385.

The first blade groove 381 is also referred to as a tip-side first blade groove, and the second blade groove 382 as a tip-side second blade groove. The fifth blade groove 385 is also referred to as a base-side first blade groove, the fourth blade groove 384 as a base-side second blade groove, and the third blade groove 383 as a base-side third blade groove.

In the turbine rotor blade 24 according to an embodiment, the blade root portion 50 has a bearing surface 54. The bearing surface 54 is a portion of the surface of each tooth 51 that comes into contact with the surface of each blade groove 38 of the rotor disc 35 when the rotor disc 35 rotates and centrifugal force acts on the turbine rotor blade 24. In other words, the bearing surface 54 is a surface that faces the direction from the blade root portion 50 to the airfoil portion 44 in the blade height direction (i.e., a surface that faces outward in the radial direction).

As shown in FIG. 4, the blade root portion 50 may extend obliquely to the axial direction. That is, the blade root portion 50 of the turbine rotor blade 24 may be inserted into the blade groove portion 37 provided in the rotor disc 35 obliquely to the axial direction.

The blade root portion 50 of the turbine rotor blade 24 is repeatedly subjected to centrifugal stress due to a centrifugal load transmitted from the airfoil portion 44 or thermal stress due to a temperature difference from the platform 42. In the blade root portion 50 with the plurality of teeth 51 formed at different positions in the blade height direction, the stress may vary with each tooth 51. For example, the stress on the tooth 51 (fifth tooth 515) closest to the base in the blade height direction may be greater than the stress on the other teeth 51. In this case, if the thickness of the tooth (fifth tooth 515) closest to the base increases, the strength of the tooth (fifth tooth 515) increases and the stress decreases, but the side effect is that the stress in the portion of the rotor disc 35 that forms the blade groove 38 (fifth blade groove 385) in contact with the tooth (fifth tooth 515) increases. Therefore, when reducing the stress on the tooth (fifth tooth 515) by increasing the thickness of the tooth (fifth tooth 515), it is necessary to consider suppression of the stress on this portion.

Then, in the turbine rotor blade 24 according to an embodiment, in order to achieve both the reduction in the stress on the fifth tooth 515 and the suppression of the stress on the portion of the rotor disc 35 that forms the fifth blade groove 385, the teeth 51 are formed as follows.

Figure 5:
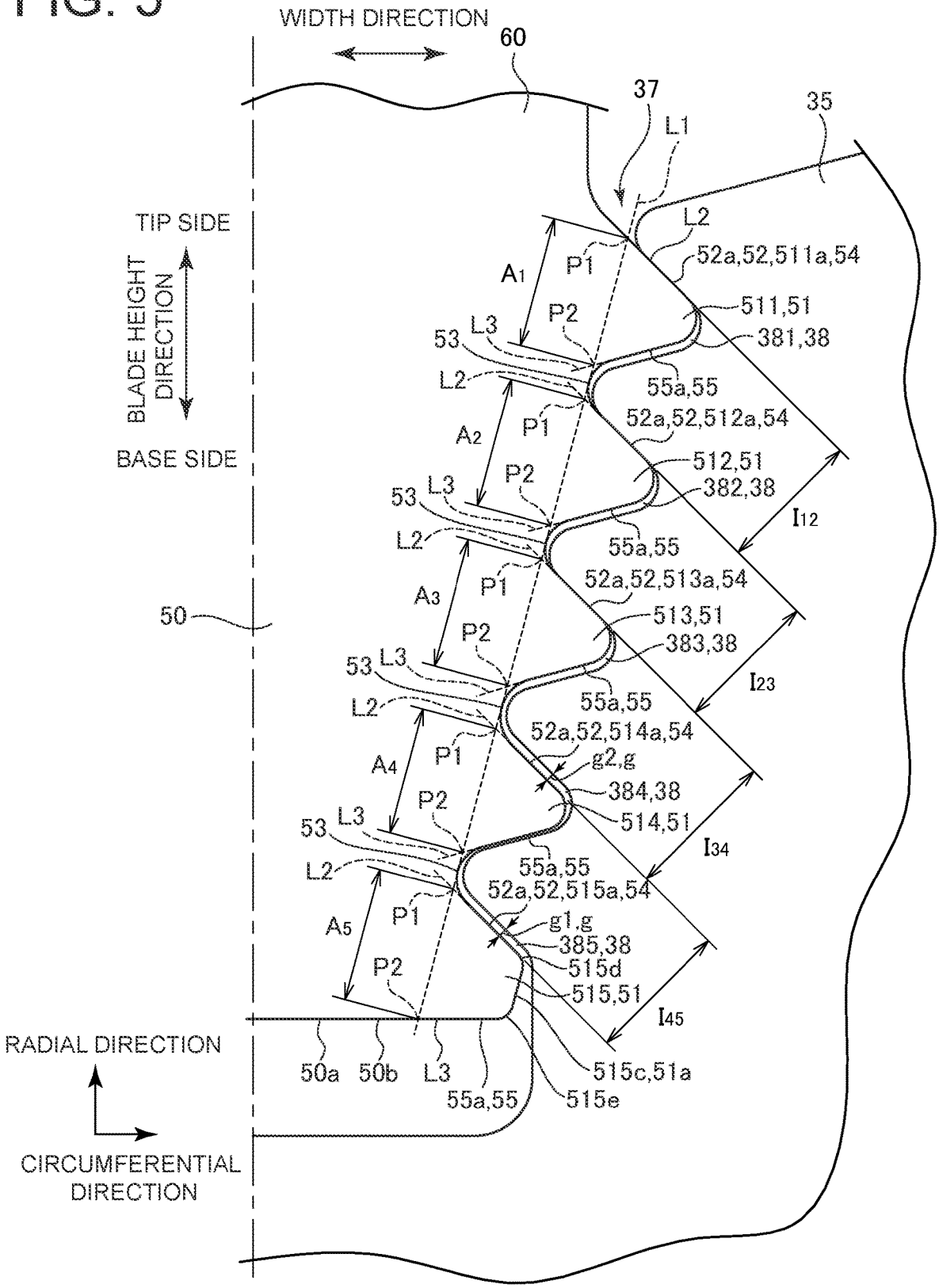
FIG. 5 is a schematic enlarged view of an engagement portion between each tooth and each groove in FIG. 2.

FIG. 5 is a schematic enlarged view of an engagement portion between each tooth 51 and each blade groove 38 in FIG. 2.

In the turbine rotor blade 24 according to an embodiment, one of spacing $I_{45}$ between the base-side first tooth (fifth tooth 515) and the base-side second tooth (fourth tooth 514) or spacing $I_{34}$ between the base-side second tooth (fourth tooth 514) and the base-side third tooth (third tooth 513) is greater than spacing $I_{12}$ between the tip-side first tooth (first tooth 511) and the tip-side second tooth (second tooth 512).

Here, the spacing $I_{12}$ between the tip-side first tooth (first tooth 511) and the tip-side second tooth (second tooth 512) is the distance between the tip-side tooth surface 511*a* of the first tooth 511, i.e., the bearing surface 54 of the first tooth 511 and the tip-side tooth surface 512*a* of the second tooth 512, i.e., the bearing surface 54 of the second tooth 512.

Similarly, the spacing $I_{23}$ between the tip-side second tooth (second tooth 512) and the tip-side third tooth (third tooth 513) is the distance between the tip-side tooth surface 512*a* of the second tooth 512, i.e., the bearing surface 54 of the second tooth 512 and the tip-side tooth surface 513*a* of the third tooth 513, i.e., the bearing surface 54 of the third tooth 513. The spacing $I_{45}$ between the base-side first tooth (fifth tooth 515) and the base-side second tooth (fourth tooth 514) is the distance between the tip-side tooth surface 515*a* of the fifth tooth 515, i.e., the bearing surface 54 of the fifth tooth 515 and the tip-side tooth surface 514*a* of the fourth tooth 514, i.e., the bearing surface 54 of the fourth tooth 514.

The spacing $I_{34}$ between the base-side second tooth (fourth tooth 514) and the base-side third tooth (third tooth 513) is the distance between tip-side tooth surface 514*a* of the fourth tooth 514, i.e., the bearing surface 54 of the fourth tooth 514 and the tip-side tooth surface 513*a* of the third tooth 513, i.e., the bearing surface 54 of the third tooth 513.

In a cross-section perpendicular to the extension direction of the plurality of teeth 51, that is, in the schematic cross-section shown in FIG. 5, a straight line that connects tooth bottom portions 53 formed between each adjacent teeth 51 in the blade height direction is a first line L1.

In the cross-section, an intersection between the first line L1 and a second line L2 that includes a linear portion 52*a* of the tip-side tooth surface 52 of each of the plurality of teeth 51 is a first intersection P1.

An intersection between the first line L1 and a third line L3 that includes a linear portion 55*a* of the base-side tooth surface 55 of each of the plurality of teeth 51 is a second intersection P2.

In the turbine rotor blade 24 according to an embodiment, the shape of each tooth 51 is set so that all straight lines connecting two adjacent tooth bottom portions 53 are aligned with the first line L1. This enables a proper distribution of load on the teeth 51.

In the turbine rotor blade 24 according to an embodiment, a distance $A_5$ between the first intersection P1 and the second intersection P2 in the base-side first tooth (fifth tooth 515) is greater than a distance $A_1$, $A_2$, $A_3$, $A_4$ between the first intersection P1 and the second intersection P2 in each tooth 51 other than the base-side first tooth (fifth tooth 515).

The distance $A_1$ is between the first intersection P1 and the second intersection P2 in the first tooth 511, the distance $A_2$ is between the first intersection P1 and the second intersection P2 in the second tooth 512, the distance $A_3$ is between the first intersection P1 and the second intersection P2 in the third tooth 513, and the distance $A_4$ is between the first intersection P1 and the second intersection P2 in the fourth tooth 514.

In the turbine rotor blade 24 according to an embodiment, since the distance $A_5$ between the first intersection P1 and the second intersection P2 in the base-side first tooth (fifth tooth 515) is greater than the distance $A_1$, $A_2$, $A_3$, $A_4$ between the first intersection P1 and the second intersection P2 in each tooth 51 other than the base-side first tooth (fifth tooth 515), the thickness of the base-side first tooth (fifth tooth 515) is greater than the thickness of each tooth 51 other than the base-side first tooth (fifth tooth 515). Thus, it is possible to suppress the stress on the base-side first tooth (fifth tooth 515).

The rotor disc 35 having the blade groove portion 37 capable of engaging with the blade root portion 50 of the turbine rotor blade 24 has a plurality of blade grooves 38 capable of engaging with the plurality of teeth 51 formed at different positions in the blade height direction. In a typical rotor disc, spacing between the blade grooves 38 of the rotor disc 35 adjacent in the blade height direction (the radial direction of the rotor disc 35) is the same between any two blade grooves adjacent in the radial direction of the rotor disc.

The spacing between the blade grooves 38 adjacent in the radial direction of the rotor disc is, for example, a distance between the surfaces of the blade grooves 38 that face the bearing surfaces 54 of the respective teeth 51. In the turbine 6 according to an embodiment, the spacing between the blade grooves 38 adjacent in the radial direction of the rotor disc 35 is the same between any two blade grooves 38 adjacent in the radial direction of the rotor disc 35.

Therefore, when the spacing $I_{45}$ between the base-side first tooth (fifth tooth 515) and the base-side second tooth (fourth tooth 514) is greater than the spacing $I_{12}$ between the tip-side first tooth (first tooth 511) and the tip-side second tooth (second tooth 512), with a sufficiently low rotation speed of the rotor disc 35, a gap g is formed between the tip-side tooth surface 515*a* of the base-side first tooth (fifth tooth 515) and the blade groove 38 (fifth blade groove 385) that engages with the base-side first tooth (fifth tooth 515) when the tip-side tooth surface 511*a* of the tip-side first tooth (first tooth 511) is in close contact with the blade groove 38 (first blade groove 381) that engages with the tip-side first tooth (first tooth 511). Further, when the spacing $I_{34}$ between the base-side second tooth (fourth tooth 514) and the base-side third tooth (third tooth 513) is greater than the spacing $I_{12}$ between the tip-side first tooth (first tooth 511) and the tip-side second tooth (second tooth 512), with a sufficiently low rotation speed of the rotor disc 35, a gap g is formed between the tip-side tooth surface 515*a* of the base-side first tooth (fifth tooth 515) and the blade groove 38 (fifth blade groove 385) that engages with the base-side first tooth (fifth tooth 515) and between the tip-side tooth surface 514*a* of the base-side second tooth (fourth tooth 514) and the blade groove 38 (fourth blade groove 384) that engages with the base-side second tooth (fourth tooth 514) when the tip-side tooth surface 511*a* of the tip-side first tooth (first tooth 511) is in close contact with the blade groove 38 (first blade groove 381) that engages with the tip-side first tooth (first tooth 511).

In the example shown in FIG. 5, the spacing $I_{34}$ between the base-side second tooth (fourth tooth 514) and the base-side third tooth (third tooth 513) is greater than the spacing $I_{12}$ between the tip-side first tooth (first tooth 511) and the tip-side second tooth (second tooth 512). In the example shown in FIG. 5, the spacing $I_{45}$ between the base-side first tooth (fifth tooth 515) and the base-side second tooth (fourth tooth 514) is equal to the spacing $I_{12}$ between the tip-side first tooth (first tooth 511) and the tip-side second tooth (second tooth 512). In the example shown in FIG. 5, the spacing $I_{23}$ between the tip-side second tooth (second tooth 512) and the base-side third tooth (third tooth 513) is equal to the spacing $I_{12}$ between the tip-side first tooth (first tooth 511) and the tip-side second tooth (second tooth 512).

Accordingly, when the turbine rotor blade 24 according to an embodiment is attached to the rotor disc 35 having the same configuration as a typical rotor disc, with a sufficiently low rotation speed of the rotor disc 35, a gap g is formed between the tip-side tooth surface 515*a* of the base-side first tooth (fifth tooth 515) and the blade groove 38 (fifth blade groove 385) that engages with the base-side first tooth (fifth tooth 515) when the tip-side tooth surface 511*a* of the tip-side first tooth (first tooth 511) is in close contact with the blade groove 38 (first blade groove 381) that engages with the tip-side first tooth (first tooth 511). Thus, with the turbine rotor blade 24 according to an embodiment, compared to the case where both the spacing $I_{45}$ between the base-side first tooth (fifth tooth 515) and the base-side second tooth (fourth tooth 514) and the spacing $I_{34}$ between the base-side second tooth (fourth tooth 514) and the base-side third tooth (third tooth 513) are equal to the spacing $I_{12}$ between the tip-side first tooth (first tooth 511) and the tip-side second tooth (second tooth 512), it is possible to reduce the stress on the portion of the rotor disc 35 that forms the blade groove 38 (fifth blade groove 385) which comes into contact with the base-side first tooth (fifth tooth 515) when subjected to centrifugal stress due to centrifugal load transmitted from the airfoil portion 44, and the stress on the base-side first tooth (fifth tooth 515).

Therefore, with the turbine rotor blade 24 according to an embodiment, it is possible to suppress the stress on the base-side first tooth (fifth tooth 515) by increasing the thickness of the base-side first tooth (fifth tooth 515) to be greater than the thickness of each tooth 51 other than the base-side first tooth (fifth tooth 515). Additionally, with the turbine rotor blade 24 according to an embodiment, it is possible to suppress the above-described side effect due to increasing the thickness of the base-side first tooth (fifth tooth 515) to be greater than the thickness of each tooth 51 other than the base-side first tooth (fifth tooth 515).

In the turbine rotor blade 24 according to an embodiment, the distance $A_5$ between the first intersection P1 and the second intersection P2 in the base-side first tooth (fifth tooth 515) may be 101% or more and 105% or less of the distance $A_4$ between the first intersection P1 and the second intersection P2 in the base-side second tooth (fourth tooth 514).

As described above, if the thickness of the tooth 51 (fifth tooth 515) closest to the base increases, the strength of the tooth (fifth tooth 515) increases and the stress decreases, but the side effect is that the stress in the portion of the rotor disc 35 that forms the blade groove 38 (fifth blade groove 385) in contact with the tooth (fifth tooth 515) increases. As described above, when one of the spacing $I_{45}$ between the base-side first tooth (fifth tooth 515) and the base-side second tooth (fourth tooth 514) or the spacing $I_{34}$ between the base-side second tooth (fourth tooth 514) and the base-side third tooth (third tooth 513) is greater than the spacing $I_{12}$ between the tip-side first tooth (first tooth 511) and the tip-side second tooth (second tooth 512), it is possible to suppress the above-described side effect. However, when one of the spacing $I_{45}$ between the base-side first tooth (fifth tooth 515) and the base-side second tooth (fourth tooth 514) or the spacing $I_{34}$ between the base-side second tooth (fourth tooth 514) and the base-side third tooth (third tooth 513) is excessively greater than the spacing $I_{12}$ between the tip-side first tooth (first tooth 511) and the tip-side second tooth (second tooth 512), another side effect is that the stress on the portion that forms the blade groove 38 capable of engaging with the tooth 51 on the tip side of the base-side first tooth (fifth tooth 515) or the base-side second tooth (fourth tooth 514) increases.

As a result of intensive studies by the inventors, it was found that when the distance $A_5$ between the first intersection P1 and the second intersection P2 in the base-side first tooth (fifth tooth 515) is 101% or more and 105% or less of the distance $A_4$ between the first intersection P1 and the second intersection P2 in the base-side second tooth (fourth tooth 514), by appropriately setting the spacing $I_{45}$ between the base-side first tooth (fifth tooth 515) and the base-side second tooth (fourth tooth 514) or the spacing $I_{34}$ between the base-side second tooth (fourth tooth 514) and the base-side third tooth (third tooth 513), it is possible to suppress the above-described side effect and other side effect.

Thus, it is possible to suppress the stress on the base-side first tooth (fifth tooth 515) while preventing the stress on the rotor disc 35 from locally increasing.

In the turbine rotor blade 24 according to an embodiment, the distance $A_5$ between the first intersection P1 and the second intersection P2 in the base-side first tooth (fifth tooth 515) may be 102% or more and 104% or less of the distance $A_4$ between the first intersection P1 and the second intersection P2 in the base-side second tooth (fourth tooth 514).

As a result of intensive studies by the inventors, it was found that when the distance $A_5$ between the first intersection P1 and the second intersection P2 in the base-side first tooth (fifth tooth 515) is 102% or more and 104% or less of the distance $A_4$ between the first intersection P1 and the second intersection P2 in the base-side second tooth (fourth tooth 514), by appropriately setting the spacing $I_{45}$ between the base-side first tooth (fifth tooth 515) and the base-side second tooth (fourth tooth 514) or the spacing $I_{34}$ between the base-side second tooth (fourth tooth 514) and the base-side third tooth (third tooth 513), it is possible to further suppress the above-described other side effect.

Thus, it is possible to suppress the stress on the base-side first tooth (fifth tooth 515) while further preventing the stress on the rotor disc 35 from locally increasing.

Figure 6:
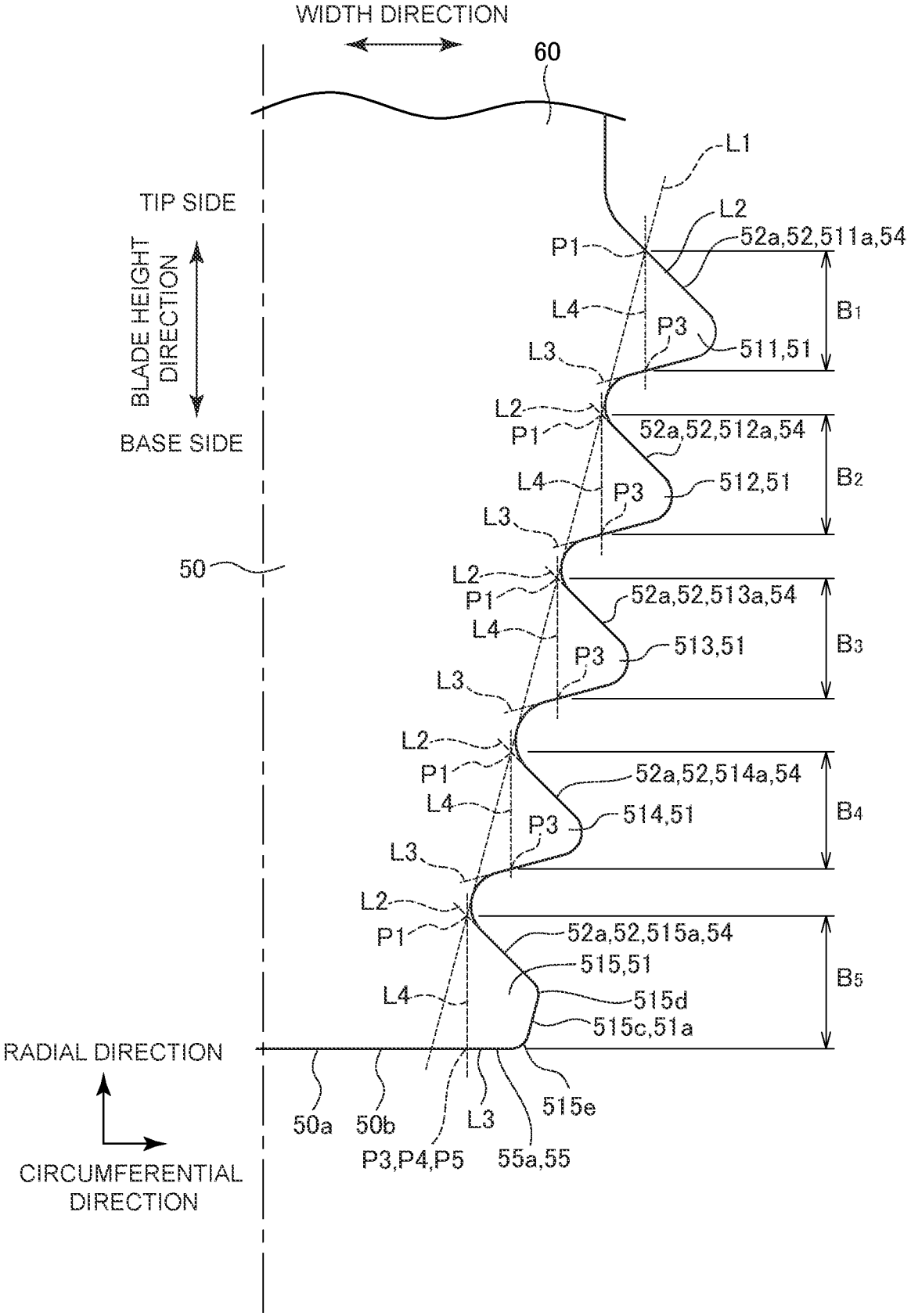
FIG. 6 is a schematic enlarged view of an engagement portion between each tooth and each groove in FIG. 2.

FIG. 6 is a schematic enlarged view of an engagement portion between each tooth 51 and each blade groove 38 in FIG. 2, where only the teeth 51 are shown.

In the turbine rotor blade 24 according to an embodiment, when, in a cross-section perpendicular to the extension direction of the plurality of teeth 51, that is, in the schematic cross-section shown in FIG. 6, an intersection between the third line L3 and a fourth line L4 that is parallel to the blade height direction and passes through the first intersection P1 in each of the plurality of teeth 51 is a third intersection P3, a distance $B_5$ between the first intersection P1 and the third intersection P3 in the base-side first tooth (fifth tooth 515) may be greater than a distance $B_1$, $B_2$, $B_3$, $B_4$ between the first intersection P1 and the third intersection P3 in each tooth 51 other than the base-side first tooth (fifth tooth 515).

The distance $B_1$ is between the first intersection P1 and the third intersection P3 in the first tooth 511, the distance $B_2$ is between the first intersection P1 and the third intersection P3 in the second tooth 512, the distance $B_3$ is between the first intersection P1 and the third intersection P3 in the third tooth 513, and the distance $B_4$ is between the first intersection P1 and the third intersection P3 in the fourth tooth 514.

When subjected to centrifugal stress due to centrifugal load transmitted from the airfoil portion 44, each of the plurality of teeth 51 is subjected to a force from the rotor disc 35 along the blade height direction, that is, the extension direction of the fourth line L4. Thus, the distances $B_1$, $B_2$, $B_3$, $B_4$ and $B_5$ between the first intersection P1 and the third intersection P3 are closely related to the strengths of the respective teeth 51.

With the turbine rotor blade 24 according to an embodiment, since the strength of the base-side first tooth (fifth tooth 515) is greater than the strength of each tooth 51 other than the base-side first tooth (fifth tooth 515), it is possible to suppress the stress on the base-side first tooth (fifth tooth 515).

In the turbine rotor blade 24 according to an embodiment, the distance $B_5$ between the first intersection P1 and the third intersection P3 in the base-side first tooth (fifth tooth 515) may be 101% or more and 130% or less of the distance $B_4$ between the first intersection P1 and the third intersection P3 in the base-side second tooth (fourth tooth 514).

As described above, if the strength of the tooth 51 (fifth tooth 515) closest to the base increases, the stress on the tooth (fifth tooth 515) decreases, but the side effect is that the stress on the portion of the rotor disc 35 that forms the blade groove 38 (fifth blade groove 385) in contact with the tooth (fifth tooth 515) increases. As described above, when one of the spacing $I_{45}$ between the base-side first tooth (fifth tooth 515) and the base-side second tooth (fourth tooth 514) or the spacing $I_{34}$ between the base-side second tooth (fourth tooth 514) and the base-side third tooth (third tooth 513) is greater than the spacing $I_{12}$ between the tip-side first tooth (first tooth 511) and the tip-side second tooth (second tooth 512), it is possible to suppress this side effect. However, when one of the spacing $I_{45}$ between the base-side first tooth (fifth tooth 515) and the base-side second tooth (fourth tooth 514) or the spacing $I_{34}$ between the base-side second tooth (fourth tooth 514) and the base-side third tooth (third tooth 513) is excessively greater than the spacing $I_{12}$ between the tip-side first tooth (first tooth 511) and the tip-side second tooth (second tooth 512), another side effect is that the stress on the portion that forms the blade groove 38 capable of engaging with the tooth 51 on the tip side of the base-side first tooth (fifth tooth 515) or the base-side second tooth (fourth tooth 514) increases.

As a result of intensive studies by the inventors, it was found that when the distance $B_5$ between the first intersection P1 and the third intersection P3 in the base-side first tooth (fifth tooth 515) is 101% or more and 130% or less of the distance $B_4$ between the first intersection P1 and the third intersection P3 in the base-side second tooth (fourth tooth 514), by appropriately setting the spacing $I_{45}$ between the base-side first tooth (fifth tooth 515) and the base-side second tooth (fourth tooth 514) or the spacing $I_{34}$ between the base-side second tooth (fourth tooth 514) and the base-side third tooth (third tooth 513), it is possible to suppress the above-described side effect and other side effect.

Thus, it is possible to suppress the stress on the base-side first tooth (fifth tooth 515) while preventing the stress on the rotor disc 35 from locally increasing.

In the turbine rotor blade 24 according to an embodiment, the distance $B_5$ between the first intersection P1 and the third intersection P3 in the base-side first tooth (fifth tooth 515) may be 105% or more and 110% or less of the distance $B_4$ between the first intersection P1 and the third intersection P3 in the base-side second tooth (fourth tooth 514).

As a result of intensive studies by the inventors, it was found that when the distance $B_5$ between the first intersection P1 and the third intersection P3 in the base-side first tooth (fifth tooth 515) is 105% or more and 110% or less of the distance $B_4$ between the first intersection P1 and the third intersection P3 in the base-side second tooth (fourth tooth 514), by appropriately setting the spacing $I_{45}$ between the base-side first tooth (fifth tooth 515) and the base-side second tooth (fourth tooth 514) or the spacing $I_{34}$ between the base-side second tooth (fourth tooth 514) and the base-side third tooth (third tooth 513), it is possible to further suppress the above-described other side effect.

Thus, it is possible to suppress the stress on the base-side first tooth (fifth tooth 515) while further preventing the stress on the rotor disc 35 from locally increasing.

Figure 7:
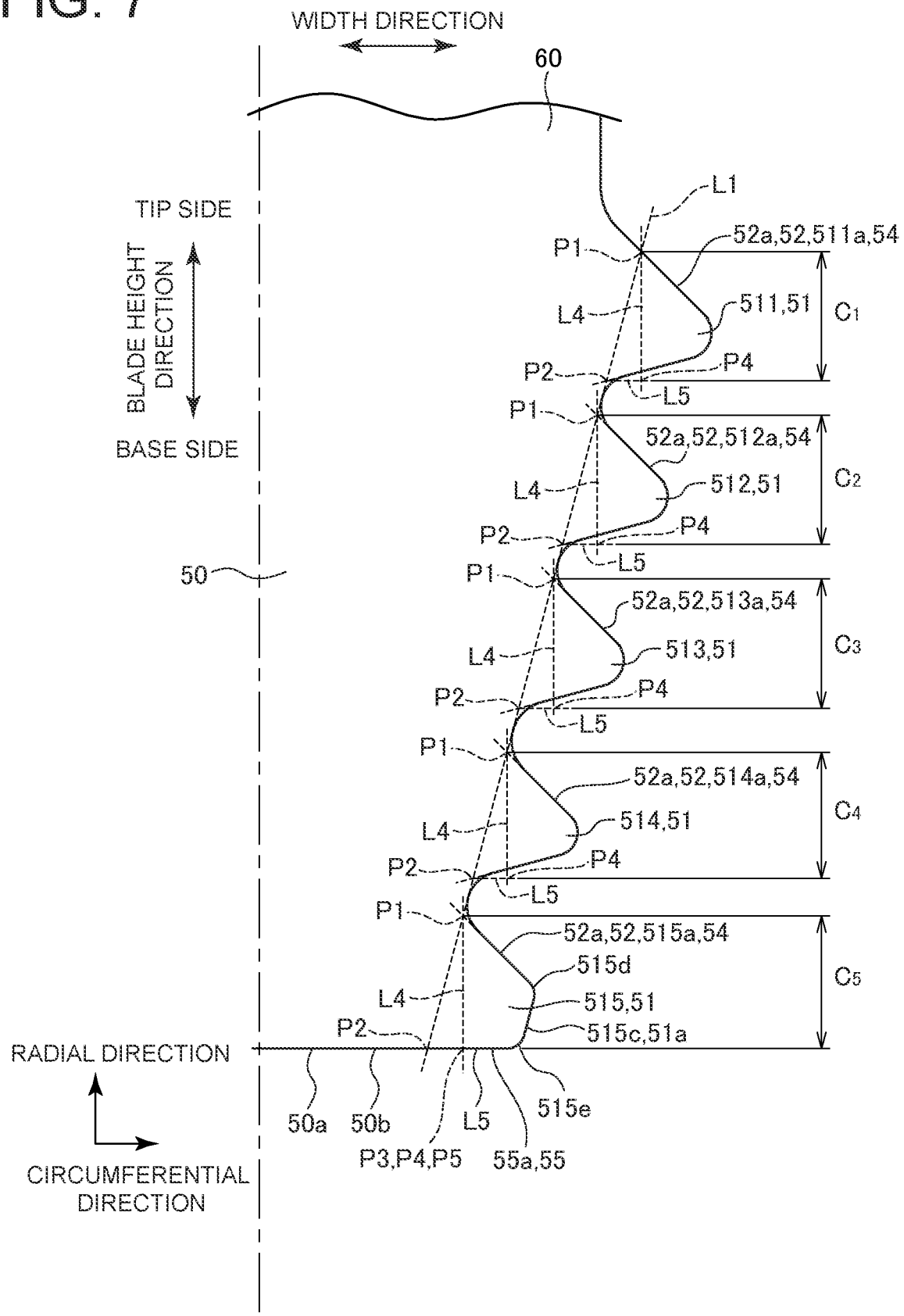
FIG. 7 is a schematic enlarged view of an engagement portion between each tooth and each groove in FIG. 2.

FIG. 7 is a schematic enlarged view of an engagement portion between each tooth 51 and each blade groove 38 in FIG. 2, where only the teeth 51 are shown.

In the turbine rotor blade 24 according to an embodiment, when, in a cross-section perpendicular to the extension direction of the plurality of teeth 51, that is, in the schematic cross-section shown in FIG. 7, an intersection between a fourth line L4 that is parallel to the blade height direction and passes through the first intersection P1 and a fifth line L5 that is perpendicular to the blade height direction and passes through the second intersection P2 in each of the plurality of teeth 51 is a fourth intersection P4, a distance $C_5$ between the first intersection P1 and the fourth intersection P4 in the base-side first tooth (fifth tooth 515) may be greater than a distance $C_1$, $C_2$, $C_3$, $C_4$ between the first intersection P1 and the fourth intersection P4 in each tooth 51 other than the base-side first tooth (fifth tooth 515).

The distance $C_1$ is between the first intersection P1 and the fourth intersection P4 in the first tooth 511, the distance $C_2$ is between the first intersection P1 and the fourth intersection P4 in the second tooth 512, the distance $C_3$ is between the first intersection P1 and the fourth intersection P4 in the third tooth 513, and the distance $C_4$ is between the first intersection P1 and the fourth intersection P4 in the fourth tooth 514.

In each of the plurality of teeth 51, the distances $C_1$, $C_2$, $C_3$, $C_4$ and $C_5$ between the first intersection P1 and the fourth intersection P4 correspond to the blade height components of the distances $A_1$, $A_2$, $A_3$, $A_4$ and $A_5$ between the first intersection P1 and the second intersection P2. Therefore, as described above, when the distance $A_5$ between the first intersection P1 and the second intersection P2 in the base-side first tooth (fifth tooth 515) is greater than the distance $A_1$, $A_2$, $A_3$, $A_4$ between the first intersection P1 and the second intersection P2 in each tooth 51 other than the base-side first tooth (fifth tooth 515), the distance $C_5$ between the first intersection P1 and the fourth intersection P4 in the base-side first tooth (fifth tooth 515) is greater than the distance $C_1$, $C_2$, $C_3$, $C_4$ between the first intersection P1 and the fourth intersection P4 in each tooth 51 other than the base-side first tooth (fifth tooth 515).

Thus, since the thickness of the base-side first tooth (fifth tooth 515) is greater than the thickness of each tooth 51 other than the base-side first tooth (fifth tooth 515), it is possible to suppress the stress on the base-side first tooth (fifth tooth 515).

In the turbine rotor blade 24 according to an embodiment, the distance $C_5$ between the first intersection P1 and the fourth intersection P4 in the base-side first tooth (fifth tooth 515) may be 100.5% or more and 110% or less of the distance $C_4$ between the first intersection P1 and the fourth intersection P4 in the base-side second tooth (fourth tooth 514).

As described above, if the strength of the tooth 51 (fifth tooth 515) closest to the base increases, the stress on the tooth (fifth tooth 515) decreases, but the side effect is that the stress in the portion of the rotor disc 35 that forms the blade groove 38 (fifth blade groove 385) in contact with the tooth (fifth tooth 515) increases. As described above, when one of the spacing $I_{45}$ between the base-side first tooth (fifth tooth 515) and the base-side second tooth (fourth tooth 514) or the spacing $I_{34}$ between the base-side second tooth (fourth tooth 514) and the base-side third tooth (third tooth 513) is greater than the spacing $I_{12}$ between the tip-side first tooth (first tooth 511) and the tip-side second tooth (second tooth 512), it is possible to suppress this side effect. However, when one of the spacing $I_{45}$ between the base-side first tooth (fifth tooth 515) and the base-side second tooth (fourth tooth 514) or the spacing $I_{34}$ between the base-side second tooth (fourth tooth 514) and the base-side third tooth (third tooth 513) is excessively greater than the spacing $I_{12}$ between the tip-side first tooth (first tooth 511) and the tip-side second tooth (second tooth 512), another side effect is that the stress on the portion that forms the blade groove 38 capable of engaging with the tooth 51 on the tip side of the base-side first tooth (fifth tooth 515) or the base-side second tooth (fourth tooth 514) increases.

As a result of intensive studies by the inventors, it was found that when the distance $C_5$ between the first intersection P1 and the fourth intersection P4 in the base-side first tooth (fifth tooth 515) is 100.5% or more and 110% or less of the distance $C_4$ between the first intersection P1 and the fourth intersection P4 in the base-side second tooth (fourth tooth 514), by appropriately setting the spacing $I_{45}$ between the base-side first tooth (fifth tooth 515) and the base-side second tooth (fourth tooth 514) or the spacing $I_{34}$ between the base-side second tooth (fourth tooth 514) and the base-side third tooth (third tooth 513), it is possible to suppress the above-described side effect and other side effect.

Thus, it is possible to suppress the stress on the base-side first tooth (fifth tooth 515) while preventing the stress on the rotor disc 35 from locally increasing.

In the turbine rotor blade 24 according to an embodiment, the distance $C_5$ between the first intersection P1 and the fourth intersection P4 in the base-side first tooth (fifth tooth 515) may be 100.5% or more and 105% or less of the distance $C_4$ between the first intersection P1 and the fourth intersection P4 in the base-side second tooth (fourth tooth 514).

As a result of intensive studies by the inventors, it was found that when the distance $C_5$ between the first intersection P1 and the fourth intersection P4 in the base-side first tooth (fifth tooth 515) is 100.5% or more and 105% or less of the distance $C_4$ between the first intersection P1 and the fourth intersection P4 in the base-side second tooth (fourth tooth 514), by appropriately setting the spacing $I_{45}$ between the base-side first tooth (fifth tooth 515) and the base-side second tooth (fourth tooth 514) or the spacing $I_{34}$ between the base-side second tooth (fourth tooth 514) and the base-side third tooth (third tooth 513), it is possible to further suppress the above-described other side effect.

Thus, it is possible to suppress the stress on the base-side first tooth (fifth tooth 515) while further preventing the stress on the rotor disc 35 from locally increasing.

In the turbine rotor blade 24 according to an embodiment, the base-side first tooth (fifth tooth 515) may have a tooth tip linear portion 515*c* formed at the tooth tip portion 51*a* of the base-side first tooth (fifth tooth 515) in a cross-section perpendicular to the extension direction of the plurality of teeth 51, that is, in the schematic cross-sections shown in FIGS. 5 to 7. The tooth tip linear portion 515*c* and the linear portion 52*a* of the tip-side tooth surface 515*a* may be connected by a curve 515*d* in the cross-section. The tooth tip linear portion 515*c* and the linear portion 55*a* of the base-side tooth surface 55 may be connected by a curve 515*e* in the cross-section.

This avoids the tooth tip portion 51*a* of the base-side first tooth (fifth tooth 515) protruding unnecessarily from the other teeth 51 in the cross-section.

In the turbine rotor blade 24 according to an embodiment, a base-side end surface 50*a* of the blade root portion 50 may have a bottom linear portion 50*b* perpendicular to the blade height direction in the cross-section. A fifth intersection P5 between the base-side end surface 50*a* and the fourth line L4 that is parallel to the blade height direction and passes through the first intersection P1 of the base-side first tooth (fifth tooth 515) may be on the bottom linear portion 50*b*.

Thereby, in the cross-section, compared to the case where the fifth intersection P5 is on the curve 515*e* connecting the tooth tip portion 51*a* of the base-side first tooth (fifth tooth 515) and the bottom linear portion 50*b*, the distance between the first intersection P1 and the fifth intersection P5 of the base-side first tooth (fifth tooth 515) increases. As a result, compared to the case where the fifth intersection P5 is on the curve 515*e* connecting the tooth tip portion 51*a* of the base-side first tooth (fifth tooth 515) and the bottom linear portion 50*b*, the thickness of the base-side first tooth (fifth tooth 515) can be increased.

A turbine rotor blade assembly 90 (see FIG. 2) according to at least one embodiment of the present disclosure includes the turbine rotor blade 24 according to an embodiment and a rotor disc 35 having a blade groove portion 37 capable of engaging with the blade root portion 50 of the turbine rotor blade 24. The blade groove portion 37 has a base-side first blade groove (fifth blade groove 385) capable of engaging with the base-side first tooth (fifth tooth 515), a base-side second blade groove (fourth blade groove 384) capable of engaging with the base-side second tooth (fourth tooth 514), a base-side third blade groove (third blade groove 383) capable of engaging with the base-side third tooth (third tooth 513), a tip-side first blade groove (first blade groove 381) capable of engaging with the tip-side first tooth (first tooth 511), and a tip-side second blade groove (second blade groove 382) capable of engaging with the tip-side second tooth (second tooth 512). When the tip-side tooth surface 511*a* of the tip-side first tooth (first tooth 511) is in close contact with the tip-side first blade groove (first blade groove 381), at least a first gap g1 is formed between the tip-side tooth surface 515*a* of the base-side first tooth (fifth tooth 515) and the base-side first blade groove (fifth blade groove 385).

Since the thickness of the base-side first tooth (fifth tooth 515) is greater than the thickness of each tooth 51 other than the base-side first tooth (fifth tooth 515), it is possible to suppress the stress on the base-side first tooth (fifth tooth 515).

Since at least the first gap g1 is formed between the tip-side tooth surface 515*a* of the base-side first tooth (fifth tooth 515) and the base-side first blade groove (fifth blade groove 385) when the tip-side tooth surface 511*a* of the tip-side first tooth (first tooth 511) is in close contact with the tip-side first blade groove (first blade groove 381), it is possible to reduce the stress on the portion that forms the base-side first blade groove (fifth blade groove 385) when subjected to centrifugal stress due to centrifugal load transmitted from the airfoil portion 44, and the stress on the base-side first tooth (fifth tooth 515).

Thus, it is possible to suppress the above-described side effect due to increasing the thickness of the base-side first tooth (fifth tooth 515) to be greater than the thickness of each tooth 51 other than the base-side first tooth (fifth tooth 515).

In the turbine rotor blade assembly 90 according to an embodiment, when the tip-side tooth surface 511*a* of the tip-side first tooth (first tooth 511) is in close contact with the tip-side first blade groove (first blade groove 381), a second gap g2 may be formed between the tip-side tooth surface 514*a* of the base-side second tooth (fourth tooth 514) and the base-side second blade groove (fourth blade groove 384).

Thus, it is possible to suppress the stress on the portion that forms the base-side second blade groove (fourth blade groove 384) and the stress on the base-side second tooth (fourth tooth 514).

In the turbine rotor blade assembly 90 according to an embodiment, the distance $A_5$ between the first intersection P1 and the second intersection P2 in the base-side first tooth (fifth tooth 515) may be 820 times or more and 830 times or less the first gap g1.

As a result of intensive studies by the inventors, it was found that when the distance $A_5$ between the first intersection P1 and the second intersection P2 in the base-side first tooth (fifth tooth 515) and the first gap g1 are set so that the distance $A_5$ between the first intersection P1 and the second intersection P2 in the base-side first tooth (fifth tooth 515) is 820 times or more and 830 times or less the first gap g1, it is possible to suppress the above-described side effect and other side effect.

Thus, it is possible to suppress the stress on the base-side first tooth (fifth tooth 515) while preventing the stress on the rotor disc 35 from locally increasing.

In the turbine rotor blade assembly 90 according to an embodiment, the distance $B_5$ between the first intersection P1 and the third intersection P3 in the base-side first tooth (fifth tooth 515) may be 770 times or more and 820 times or less the first gap g1.

As a result of intensive studies by the inventors, it was found that when the distance $B_5$ between the first intersection P1 and the third intersection P3 in the base-side first tooth (fifth tooth 515) and the first gap g1 are set so that the distance $B_5$ between the first intersection P1 and the third intersection P3 in the base-side first tooth (fifth tooth 515) is 770 times or more and 820 times or less the first gap g1, it is possible to suppress the above-described side effect and other side effect.

Thus, it is possible to suppress the stress on the base-side first tooth (fifth tooth 515) while preventing the stress on the rotor disc 35 from locally increasing.

A gas turbine 1 according to an embodiment includes a plurality of turbine rotor blades 24 each of which has an airfoil portion 44 and a blade root portion 50, and a rotor disc having a plurality of blade groove portions 37 capable of engaging with the blade root portions 50. At least one of the plurality of turbine rotor blades 24 is the above-described turbine rotor blade 24 according to an embodiment.

Thereby, it is possible to improve the durability of the rotor disc 35 and the turbine rotor blade 24.

(Repair Method for Gas Turbine)

A repair method for a gas turbine according to at least one embodiment of the present disclosure is a method for repairing a gas turbine 1 including a plurality of turbine rotor blades 24 each of which has an airfoil portion 44 and a blade root portion 50, and a rotor disc 35 having a plurality of blade groove portions 37 capable of engaging with the blade root portions 50. The repair method for a gas turbine according to at least one embodiment of the present disclosure includes a step of replacing at least one of the plurality of turbine rotor blades attached to the rotor disc 35 with the above-described turbine rotor blade 24 according to an embodiment.

Thus, in repairing an existing gas turbine, by replacing at least one of the plurality of turbine rotor blades attached to the rotor disc with the above-described turbine rotor blade 24 according to an embodiment, it is possible to suppress the stress on the base-side first tooth (fifth tooth 515) while preventing the stress on the rotor disc 35 of the existing gas turbine 1 from locally increasing.

The present disclosure is not limited to the embodiments described above, but includes modifications to the embodiments described above, and embodiments composed of combinations of those embodiments.

For example, in the above-described turbine rotor blade 24 according to an embodiment, five teeth 51 are formed at different positions in the blade height direction, but the number of teeth 51 may be three, four, or six or more.

When the number of teeth 51 formed at different positions in the blade height direction is three, spacing between the base-side first tooth and the base-side second tooth may be greater than spacing between the tip-side first tooth and the tip-side second tooth. Further, the distance between the first intersection P1 and the second intersection P2 in the base-side first tooth may be greater than the distance between the first intersection and the second intersection in each tooth other than the base-side first tooth. When the number of teeth 51 formed at different positions in the blade height direction is three, the base-side second tooth and the tip-side second tooth are the same tooth.

The contents described in the above embodiments would be understood as follows, for instance.

(1) A turbine rotor blade 24 according to at least one embodiment of the present disclosure includes: an airfoil portion 44; and a blade root portion 50 having a plurality of teeth 51 formed at different positions in a blade height direction. The plurality of teeth 51 includes a base-side first tooth (fifth tooth 515), a base-side second tooth (fourth tooth 514), and a base-side third tooth (third tooth 513) extending in a direction intersecting the blade height direction and arranged in order from a side closest to a base in the blade height direction, and a tip-side first tooth (first tooth 511) and a tip-side second tooth (second tooth 512) extending in the intersecting direction and arranged in order from a side closest to a tip in the blade height direction. One of spacing $I_{45}$ between the base-side first tooth (fifth tooth 515) and the base-side second tooth (fourth tooth 514) or spacing $I_{34}$ between the base-side second tooth (fourth tooth 514) and the base-side third tooth (third tooth 513) is greater than spacing $I_{12}$ between the tip-side first tooth (first tooth 511) and the tip-side second tooth (second tooth 512). When, in a cross-section perpendicular to an extension direction of the plurality of teeth 51, a straight line that connects tooth bottom portions 53 formed between each adjacent teeth 51 in the blade height direction is a first line L1, in the cross-section, an intersection between the first line L1 and a second line L2 that includes a linear portion 52*a* of a tip-side tooth surface 52 of each of the plurality of teeth 51 is a first intersection P1, and an intersection between the first line L1 and a third line L3 that includes a linear portion 55*a* of a base-side tooth surface 55 of each of the plurality of teeth 51 is a second intersection P2, a distance $A_5$ between the first intersection P1 and the second intersection P2 in the base-side first tooth (fifth tooth 515) is greater than a distance $A_1$, $A_2$, $A_3$, $A_4$ between the first intersection P1 and the second intersection P2 in each tooth 51 other than the base-side first tooth (fifth tooth 515).

With the above configuration (1), since the distance $A_5$ between the first intersection P1 and the second intersection P2 in the base-side first tooth (fifth tooth 515) is greater than the distance $A_1$, $A_2$, $A_3$, $A_4$ between the first intersection P1 and the second intersection P2 in each tooth other than the base-side first tooth (fifth tooth 515), the thickness of the base-side first tooth (fifth tooth 515) is greater than the thickness of each tooth 51 other than the base-side first tooth (fifth tooth 515). Thus, it is possible to suppress the stress on the base-side first tooth (fifth tooth 515).

The rotor disc 35 having the blade groove portion 37 capable of engaging with the blade root portion 50 of the turbine rotor blade 24 has a plurality of blade grooves 38 capable of engaging with the plurality of teeth 51 formed at different positions in the blade height direction. In a typical rotor disc, spacing between the blade grooves 38 of the rotor disc 35 adjacent in the blade height direction (the radial direction of the rotor disc 35) is the same between any two blade grooves adjacent in the radial direction of the rotor disc.

Therefore, when the spacing $I_{45}$ between the base-side first tooth (fifth tooth 515) and the base-side second tooth (fourth tooth 514) is greater than the spacing $I_{12}$ between the tip-side first tooth (first tooth 511) and the tip-side second tooth (second tooth 512), with a sufficiently low rotation speed of the rotor disc 35, a gap g is formed between the tip-side tooth surface 515*a* of the base-side first tooth (fifth tooth 515) and the blade groove 38 (fifth blade groove 385) that engages with the base-side first tooth (fifth tooth 515) when the tip-side tooth surface 511*a* of the tip-side first tooth (first tooth 511) is in close contact with the blade groove 38 (first blade groove 381) that engages with the tip-side first tooth (first tooth 511).

Further, when the spacing $I_{34}$ between the base-side second tooth (fourth tooth 514) and the base-side third tooth (third tooth 513) is greater than the spacing $I_{12}$ between the tip-side first tooth (first tooth 511) and the tip-side second tooth (second tooth 512), with a sufficiently low rotation speed of the rotor disc 35, a gap g is formed between the tip-side tooth surface 515*a* of the base-side first tooth (fifth tooth 515) and the blade groove 38 (fifth blade groove 385) that engages with the base-side first tooth (fifth tooth 515) and between the tip-side tooth surface 514*a* of the base-side second tooth (fourth tooth 514) and the blade groove 38 (fourth blade groove 384) that engages with the base-side second tooth (fourth tooth 514) when the tip-side tooth surface 511*a* of the tip-side first tooth (first tooth 511) is in close contact with the blade groove 38 (first blade groove 381) that engages with the tip-side first tooth (first tooth 511).

Accordingly, when the turbine rotor blade 24 having the above configuration (1) is attached to the rotor disc 35 having the same configuration as a typical rotor disc, with a sufficiently low rotation speed of the rotor disc 35, a gap g is formed between the tip-side tooth surface 515*a* of the base-side first tooth (fifth tooth 515) and the blade groove 38 (fifth blade groove 385) that engages with the base-side first tooth (fifth tooth 515) when the tip-side tooth surface 511*a* of the tip-side first tooth (first tooth 511) is in close contact with the blade groove 38 (first blade groove 381) that engages with the tip-side first tooth (first tooth 511). Thus, with the above configuration (1), compared to the case where both the spacing $I_{45}$ between the base-side first tooth (fifth tooth 515) and the base-side second tooth (fourth tooth 514) and the spacing $I_{34}$ between the base-side second tooth (fourth tooth 514) and the base-side third tooth (third tooth 513) are equal to the spacing $I_{12}$ between the tip-side first tooth (first tooth 511) and the tip-side second tooth (second tooth 512), it is possible to reduce the stress on the portion of the rotor disc 35 that forms the blade groove 38 (fifth blade groove 385) which comes into contact with the base-side first tooth (fifth tooth 515) when subjected to centrifugal stress due to centrifugal load transmitted from the airfoil portion 44, and the stress on the base-side first tooth (fifth tooth 515).

Therefore, with the above configuration (1), it is possible to suppress the stress on the base-side first tooth (fifth tooth 515) by increasing the thickness of the base-side first tooth (fifth tooth 515) to be greater than the thickness of each tooth 51 other than the base-side first tooth (fifth tooth 515). Additionally, with the above configuration (1), it is possible to suppress the above-described side effect due to increasing the thickness of the base-side first tooth (fifth tooth 515) to be greater than the thickness of each tooth 51 other than the base-side first tooth (fifth tooth 515).

(2) In some embodiments, in the above configuration (1), the distance $A_5$ between the first intersection P1 and the second intersection P2 in the base-side first tooth (fifth tooth 515) may be 101% or more and 105% or less of the distance $A_4$ between the first intersection P1 and the second intersection P2 in the base-side second tooth (fourth tooth 514).

With the above configuration (2), it is possible to suppress the stress on the base-side first tooth (fifth tooth 515) while preventing the stress on the rotor disc 35 from locally increasing.

(3) In some embodiments, in the above configuration (2), the distance $A_5$ between the first intersection P1 and the second intersection P2 in the base-side first tooth (fifth tooth 515) may be 102% or more and 104% or less of the distance $A_4$ between the first intersection P1 and the second intersection P2 in the base-side second tooth (fourth tooth 514).

With the above configuration (3), it is possible to suppress the stress on the base-side first tooth (fifth tooth 515) while further preventing the stress on the rotor disc 35 from locally increasing.

(4) In some embodiments, in any one of the above configurations (1) to (3), when, in the cross-section, an intersection between the third line L3 and a fourth line L4 that is parallel to the blade height direction and passes through the first intersection P1 in each of the plurality of teeth 51 is a third intersection P3, a distance $B_5$ between the first intersection P1 and the third intersection P3 in the base-side first tooth (fifth tooth 515) may be greater than a distance $B_1$, $B_2$, $B_3$, $B_4$ between the first intersection P1 and the third intersection P3 in each tooth 51 other than the base-side first tooth (fifth tooth 515).

With the above configuration (4), since the strength of the base-side first tooth (fifth tooth 515) is greater than the strength of each tooth 51 other than the base-side first tooth (fifth tooth 515), it is possible to suppress the stress on the base-side first tooth (fifth tooth 515).

(5) In some embodiments, in the above configuration (4), the distance $B_5$ between the first intersection P1 and the third intersection P3 in the base-side first tooth (fifth tooth 515) may be 101% or more and 130% or less of the distance $B_4$ between the first intersection P1 and the third intersection P3 in the base-side second tooth (fourth tooth 514).

With the above configuration (5), it is possible to suppress the stress on the base-side first tooth (fifth tooth 515) while preventing the stress on the rotor disc 35 from locally increasing.

(6) In some embodiments, in the above configuration (5), the distance $B_5$ between the first intersection P1 and the third intersection P3 in the base-side first tooth (fifth tooth 515) may be 105% or more and 110% or less of the distance $B_4$ between the first intersection P1 and the third intersection P3 in the base-side second tooth (fourth tooth 514).

With the above configuration (6), it is possible to suppress the stress on the base-side first tooth (fifth tooth 515) while further preventing the stress on the rotor disc 35 locally increasing.

(7) In some embodiments, in any one of the above configurations (1) to (6), when, in the cross-section, an intersection between a fourth line L4 that is parallel to the blade height direction and passes through the first intersection P1 and a fifth line L5 that is perpendicular to the blade height direction and passes through the second intersection P2 in each of the plurality of teeth 51 is a fourth intersection P4, a distance $C_5$ between the first intersection P1 and the fourth intersection P4 in the base-side first tooth (fifth tooth 515) may be greater than a distance $C_1$, $C_2$, $C_3$, $C_4$ between the first intersection P1 and the fourth intersection P4 in each tooth 51 other than the base-side first tooth (fifth tooth 515).

With the above configuration (7), since the thickness of the base-side first tooth (fifth tooth 515) is greater than the thickness of each tooth 51 other than the base-side first tooth (fifth tooth 515), it is possible to suppress the stress on the base-side first tooth (fifth tooth 515).

(8) In some embodiments, in the above configuration (7), the distance $C_5$ between the first intersection P1 and the fourth intersection P4 in the base-side first tooth (fifth tooth 515) may be 100.5% or more and 110% or less of the distance $C_4$ between the first intersection P1 and the fourth intersection P4 in the base-side second tooth (fourth tooth 514).

With the above configuration (8), it is possible to suppress the stress on the base-side first tooth (fifth tooth 515) while preventing the stress on the rotor disc 35 from locally increasing.

(9) In some embodiments, in the above configuration (8), the distance $C_5$ between the first intersection P1 and the fourth intersection P4 in the base-side first tooth (fifth tooth 515) may be 100.5% or more and 105% or less of the distance $C_4$ between the first intersection P1 and the fourth intersection P4 in the base-side second tooth (fourth tooth 514).

With the above configuration (9), it is possible to suppress the stress on the base-side first tooth while further preventing the stress on the rotor disc locally increasing.

(10) In some embodiments, in any one of the above configurations (1) to (9), the base-side first tooth (fifth tooth 515) may have a tooth tip linear portion 515*c* formed at the tooth tip portion Ma of the base-side first tooth (fifth tooth 515) in the cross-section. The tooth tip linear portion 515*c* and the linear portion 52*a* of the tip-side tooth surface 515*a* may be connected by a curve 515*d* in the cross-section. The tooth tip linear portion 515*c* and the linear portion 55*a* of the base-side tooth surface 55 may be connected by a curve 515*e* in the cross-section.

With the above configuration (10), it is possible to avoid the tooth tip portion 51*a* of the base-side first tooth (fifth tooth 515) protruding unnecessarily from the other teeth 51 in the cross-section.

(11) In some embodiments, in any one of the above configurations (1) to (10), a base-side end surface 50*a* of the blade root portion 50 may have a bottom linear portion 50*b* perpendicular to the blade height direction in the cross-section. A fifth intersection P5 between the base-side end surface 50*a* and the fourth line L4 that is parallel to the blade height direction and passes through the first intersection P1 of the base-side first tooth (fifth tooth 515) may be on the bottom linear portion 50*b*.

With the above configuration (11), in the cross-section, compared to the case where the fifth intersection P5 is on the curve 515*e* connecting the tooth tip portion 51*a* of the base-side first tooth (fifth tooth 515) and the bottom linear portion 50*b*, the distance between the first intersection P1 and the fifth intersection P5 of the base-side first tooth (fifth tooth 515) increases. As a result, compared to the case where the fifth intersection P5 is on the curve 515*e* connecting the tooth tip portion 51*a* of the base-side first tooth (fifth tooth 515) and the bottom linear portion 50*b*, the thickness of the base-side first tooth (fifth tooth 515) can be increased.

(12) A turbine rotor blade assembly 90 according to at least one embodiment of the present disclosure includes the turbine rotor blade 24 having any one of the above configurations (1) to (11), and a rotor disc 35 having a blade groove portion 37 capable of engaging with the blade root portion 50 of the turbine rotor blade 24. The blade groove portion 37 has a base-side first blade groove (fifth blade groove 385) capable of engaging with the base-side first tooth (fifth tooth 515), a base-side second blade groove (fourth blade groove 384) capable of engaging with the base-side second tooth (fourth tooth 514), a base-side third blade groove (third blade groove 383) capable of engaging with the base-side third tooth (third tooth 513), a tip-side first blade groove (first blade groove 381) capable of engaging with the tip-side first tooth (first tooth 511), and a tip-side second blade groove (second blade groove 382) capable of engaging with the tip-side second tooth (second tooth 512). When the tip-side tooth surface 511*a* of the tip-side first tooth (first tooth 511) is in close contact with the tip-side first blade groove (first blade groove 381), at least a first gap g1 is formed between the tip-side tooth surface 515*a* of the base-side first tooth (fifth tooth 515) and the base-side first blade groove (fifth blade groove 385).

With the above configuration (12), since the turbine rotor blade 24 having any one of the above configurations (1) to (11) is included, the thickness of the base-side first tooth (fifth tooth 515) is greater than the thickness of each tooth 51 other than the base-side first tooth (fifth tooth 515). Thus, it is possible to suppress the stress on the base-side first tooth (fifth tooth 515).

With the above configuration (12), since at least the first gap g1 is formed between the tip-side tooth surface 515*a* of the base-side first tooth (fifth tooth 515) and the base-side first blade groove (fifth blade groove 385) when the tip-side tooth surface 511*a* of the tip-side first tooth (first tooth 511) is in close contact with the tip-side first blade groove (first blade groove 381), it is possible to reduce the stress on the portion that forms the base-side first blade groove (fifth blade groove 385) when subjected to centrifugal stress due to centrifugal load transmitted from the airfoil portion 44, and the stress on the base-side first tooth (fifth tooth 515).

Thus, with the above configuration (12), it is possible to suppress the above-described side effect due to increasing the thickness of the base-side first tooth (fifth tooth 515) to be greater than the thickness of each tooth 51 other than the base-side first tooth (fifth tooth 515).

(13) In some embodiments, in the above configuration (12), when the tip-side tooth surface 511*a* of the tip-side first tooth (first tooth 511) is in close contact with the tip-side first blade groove (first blade groove 381), a second gap g2 may be formed between the tip-side tooth surface 514*a* of the base-side second tooth (fourth tooth 514) and the base-side second blade groove (fourth blade groove 384).

With the above configuration (13), it is possible to suppress the stress on the portion that forms the base-side second blade groove (fourth blade groove 384) when subjected to centrifugal stress due to centrifugal load transmitted from the airfoil portion 44, and the stress on the base-side second tooth (fourth tooth 514).

(14) In some embodiments, in the above configuration (12) or (13), the distance $A_5$ between the first intersection P1 and the second intersection P2 in the base-side first tooth (fifth tooth 515) may be 820 times or more and 830 times or less the first gap g1.

As a result of intensive studies by the inventors, it was found that when the distance $A_5$ between the first intersection P1 and the second intersection P2 in the base-side first tooth (fifth tooth 515) and the first gap g1 are set so that the distance $A_5$ between the first intersection P1 and the second intersection P2 in the base-side first tooth (fifth tooth 515) is 820 times or more and 830 times or less the first gap g1, it is possible to suppress the above-described side effect and other side effect.

With the above configuration (14), it is possible to suppress the stress on the base-side first tooth (fifth tooth 515) while preventing the stress on the rotor disc 35 from locally increasing.

(15) A gas turbine 1 according to at least one embodiment of the present disclosure includes a plurality of turbine rotor blades 24 each of which has an airfoil portion 44 and a blade root portion 50, and a rotor disc 35 having a plurality of blade groove portions 37 capable of engaging with the blade root portions 50. At least one of the plurality of turbine rotor blades 24 is the turbine rotor blade 24 having any one of the above configurations (1) to (11).

With the above configuration (15), it is possible to improve the durability of the rotor disc 35 and the turbine rotor blade 24.

(16) A repair method for a gas turbine according to at least one embodiment of the present disclosure is a method for repairing a gas turbine 1 including a plurality of turbine rotor blades 24 each of which has an airfoil portion 44 and a blade root portion 50 and a rotor disc having a plurality of blade groove portions 37 capable of engaging with the blade root portions 50, and includes a step of replacing at least one of the plurality of turbine rotor blades attached to the rotor disc 35 with the turbine rotor blade 24 having any one of the above configurations (1) to (11).

With the above method (16), in repairing an existing gas turbine, by replacing at least one of the plurality of turbine rotor blades attached to the rotor disc with the turbine rotor blade 24 having any one of the above configurations (1) to (11), it is possible to suppress the stress on the base-side first tooth (fifth tooth 515) while preventing the stress on the rotor disc of the existing gas turbine 1 from locally increasing.

The invention claimed is:

1. A turbine rotor blade, comprising:

an airfoil portion; and a blade root portion having a plurality of teeth formed at different positions in a blade height direction, wherein the plurality of teeth includes a base-side first tooth, a base-side second tooth, and a base-side third tooth extending in a direction intersecting the blade height direction and arranged in order from a side closest to a base in the blade height direction, and a tip-side first tooth and a tip-side second tooth extending in the intersecting direction and arranged in order from a side closest to a tip in the blade height direction, wherein one of spacing between a tip-side tooth surface of the base-side first tooth and a tip-side tooth surface of the base-side second tooth or spacing between the tip-side tooth surface of the base-side second tooth and a tip-side tooth surface of the base-side third tooth is greater than spacing between a tip-side tooth surface of the tip-side first tooth and a tip-side tooth surface of the tip-side second tooth, and wherein when, in a cross-section perpendicular to an extension direction of the plurality of teeth, a straight line that connects tooth bottom portions formed between each adjacent teeth in the blade height direction is a first line, in the cross-section, an intersection between the first line and a second line that includes a linear portion of a tip-side tooth surface of each of the plurality of teeth is a first intersection, and an intersection between the first line and a third line that includes a linear portion of a base-side tooth surface of each of the plurality of teeth is a second intersection, a distance between the first intersection and the second intersection in the base-side first tooth is greater than a distance between the first intersection and the second intersection in each tooth other than the base-side first tooth.

2. The turbine rotor blade according to claim 1, wherein the distance between the first intersection and the second intersection in the base-side first tooth is 101% or more and 105% or less of the distance between the first intersection and the second intersection in the base-side second tooth.

3. The turbine rotor blade according to claim 2, wherein the distance between the first intersection and the second intersection in the base-side first tooth is 102% or more and 104% or less of the distance between the first intersection and the second intersection in the base-side second tooth.

4. The turbine rotor blade according to claim 1, wherein when, in the cross-section, an intersection between the third line and a fourth line that is parallel to the blade height direction and passes through the first intersection in each of the plurality of teeth is a third intersection, a distance between the first intersection and the third intersection in the base-side first tooth is greater than a distance between the first intersection and the third intersection in each tooth other than the base-side first tooth.

5. The turbine rotor blade according to claim 4, wherein the distance between the first intersection and the third intersection in the base-side first tooth is 101% or more and 130% or less of the distance between the first intersection and the third intersection in the base-side second tooth.

6. The turbine rotor blade according to claim 5, wherein the distance between the first intersection and the third intersection in the base-side first tooth is 105% or more and 110% or less of the distance between the first intersection and the third intersection in the base-side second tooth.

7. The turbine rotor blade according to claim 1, wherein when, in the cross-section, an intersection between a fourth line that is parallel to the blade height direction and passes through the first intersection and a fifth line that is perpendicular to the blade height direction and passes through the second intersection in each of the plurality of teeth is a fourth intersection, a distance between the first intersection and the fourth intersection in the base-side first tooth is greater than a distance between the first intersection and the fourth intersection in each tooth other than the base-side first tooth.

8. The turbine rotor blade according to claim 7, wherein the distance between the first intersection and the fourth intersection in the base-side first tooth is 100.5% or more and 110% or less of the distance between the first intersection and the fourth intersection in the base-side second tooth.

9. The turbine rotor blade according to claim 8, wherein the distance between the first intersection and the fourth intersection in the base-side first tooth is 100.5% or more and 105% or less of the distance between the first intersection and the fourth intersection in the base-side second tooth.

10. The turbine rotor blade according to claim 1, wherein the base-side first tooth has a tooth tip linear portion formed at a tooth tip portion of the base-side first tooth in the cross-section, wherein the tooth tip linear portion and the linear portion of the tip-side tooth surface are connected by a curve in the cross-section, and wherein the tooth tip linear portion and the linear portion of the base-side tooth surface are connected by a curve in the cross-section.

11. The turbine rotor blade according to claim 1, wherein a base-side end surface of the blade root portion has a bottom linear portion perpendicular to the blade height direction in the cross-section, and wherein a fifth intersection between the base-side end surface and a fourth line that is parallel to the blade height direction and passes through the first intersection of the base-side first tooth is on the bottom linear portion.

12. A turbine rotor blade assembly, comprising:

the turbine rotor blade according to claim 1; and a rotor disc having a blade groove portion capable of engaging with the blade root portion of the turbine rotor blade, wherein the blade groove portion has a base-side first blade groove capable of engaging with the base-side first tooth, a base-side second blade groove capable of engaging with the base-side second tooth, a base-side third blade groove capable of engaging with the base-side third tooth, a tip-side first blade groove capable of engaging with the tip-side first tooth, and a tip-side second blade groove capable of engaging with the tip-side second tooth, and wherein, when the tip-side tooth surface of the tip-side first tooth is in close contact with the tip-side first blade groove, at least a first gap is formed between the tip-side tooth surface of the base-side first tooth and the base-side first blade groove.

13. The turbine rotor blade assembly according to claim 12, wherein, when the tip-side tooth surface of the tip-side first tooth is in close contact with the tip-side first blade groove, a second gap is formed between the tip-side tooth surface of the base-side second tooth and the base-side second blade groove.

14. The turbine rotor blade assembly according to claim 12, wherein a distance between the first intersection and the second intersection in the base-side first tooth is 820 times or more and 830 times or less the first gap.

15. A gas turbine, comprising:

a plurality of turbine rotor blades each of which has an airfoil portion and a blade root portion; and a rotor disc having a plurality of blade groove portions capable of engaging with the blade root portions, wherein at least one of the plurality of turbine rotor blades is the turbine rotor blade according to claim 1.

16. A repair method for a gas turbine including a plurality of turbine rotor blades each of which has an airfoil portion and a blade root portion and a rotor disc having a plurality of blade groove portions capable of engaging with the blade root portions, comprising a step of replacing at least one of the plurality of turbine rotor blades attached to the rotor disc with the turbine rotor blade according to claim 1.

* * * * *